US012137731B1

(12) United States Patent
Schuett

(10) Patent No.: US 12,137,731 B1
(45) Date of Patent: Nov. 12, 2024

(54) SMOKING PIPE

(71) Applicant: Donald R. Schuett, Aitkin, MN (US)

(72) Inventor: Donald R. Schuett, Aitkin, MN (US)

( * ) Notice: Subject to any disclaimer, the term of this patent is extended or adjusted under 35 U.S.C. 154(b) by 0 days.

(21) Appl. No.: 18/377,571

(22) Filed: Oct. 6, 2023

(51) Int. Cl.

| | |
|---|---|
| ***A24F 1/28*** | (2006.01) |
| ***A24F 1/32*** | (2006.01) |
| ***A24F 7/02*** | (2006.01) |
| ***A24F 7/04*** | (2006.01) |
| ***A24F 9/04*** | (2006.01) |

(52) U.S. Cl.
CPC ..... *A24F 1/28* (2013.01); *A24F 1/32* (2013.01); *A24F 7/02* (2013.01); *A24F 7/04* (2013.01); *A24F 9/04* (2013.01)

(58) Field of Classification Search
CPC ..... A24F 1/28; A24F 1/32; A24F 7/00; A24F 9/00
See application file for complete search history.

(56) References Cited

U.S. PATENT DOCUMENTS

| | | | | |
|---|---|---|---|---|
| 10,244,790 | B1 * | 4/2019 | Christie | A24F 7/04 |
| 2015/0282525 | A1 * | 10/2015 | Plojoux | A24F 3/02 239/104 |
| 2016/0073688 | A1 * | 3/2016 | Zade | A24F 7/04 131/187 |
| 2021/0015176 | A1 * | 1/2021 | Conner | A24F 7/00 |

* cited by examiner

*Primary Examiner* — Michael H. Wilson
*Assistant Examiner* — Stephanie Lynn Moore
(74) *Attorney, Agent, or Firm* — Antonio Papageorgiou, Esq; Lombard Geliebter LLP

(57) ABSTRACT

A smoking device that produces smoke by using indirect heat from a heat source such as a flame and achieves a healthier release of the desired chemical vapor from the ingredients being smoked. A smoking pipe includes a cartridge, a chamber, a barrel, a mouthpiece and a filter capable of being disassembled for cleaning and maintenance. The barrel may be indexed 1-4, so each quadrant can be heated individually and in succession.

17 Claims, 6 Drawing Sheets

SMOKING PIPE

BACKGROUND OF THE INVENTION

The present invention relates to smoking pipes in particular to smoking pipes used for smoking tobacco and other combustibles.

Most of the pipes on the market for producing vapor are expensive, relatively high tech, and battery powered to make the heat necessary to vaporize a consumable oil. Other, lower cost options include pipes that use combustion to produce smoke; but combustion causes the material to burn, thereby releasing byproducts that are not healthy and could prove to be detrimental to the lungs. Filters have been used to reduce such risks. However, common filter materials like cellulose acetate, cotton, cardboard, carbon, and geometric flow pieces cannot remove the small particles contained in the smoke that are known to cause certain toxic issues.

Accordingly, there is a need for a low cost, easy to use, safer, smoking device that produces smoke by using indirect heat from a flame and that achieves a healthier release of the desired chemical vapor from the ingredients being smoked.

SUMMARY OF THE INVENTION

A smoking pipe is provided that includes: a barrel having an elongated body having a first end and a second end opposite the first end, and at least one side extending between the first and second end; at least one mouthpiece having an elongated body having a first and a second end opposite the first end, and at least one side extending between the first and second end; at least one chamber having an elongated body having a first and a second end opposite the first end, and at least one side extending between the first and second end; wherein the barrel forms a void with openings at each end to insert a mouthpiece and a chamber at the opposite end; wherein the mouthpiece forms a void with openings at each end to insert a filter in at least one end; wherein the chamber forms a void with openings at each end to insert a consumable at least from one end.

In one embodiment, the smoking pipe further includes a contiguously fixed assembly.

In one embodiment, a barrel has a removable mouthpiece and a chamber.

In one embodiment, a mouthpiece and a chamber have an interference fit with the barrel.

In one embodiment, the mouthpiece void has a dimensional perimeter variation from the first end to the second end.

In one embodiment, the chamber has a dimensional variance in the size of the openings from the first to the second end.

In one embodiment, the chamber is made from metal.

In one embodiment, the chamber is made from a cartridge.

In one embodiment, the barrel is flat on at least one side.

In one embodiment, the barrel is index marked on at least one side.

In one embodiment, the barrel is index marked on a plurality of sides.

In one embodiment, a cleaning device detached from the smoking pipe is provided.

In one embodiment, a set of instructions is provided with a smoking pipe, arranged as a kit.

A smoking pipe is provided that includes: a barrel having an elongated body having a first end and a second end opposite the first end and at least one side extending between the first and second end and defining a smoke retention compartment, a mouthpiece having an elongated body having a first and a second end opposite the first end and at least one side extending between the first and second end and defining a smoke and filter retention compartment, a chamber having an elongated body having a first and a second end opposite the first end, and at least one side extending between the first and second end and defining a smoke and combustible retention compartment, a means for smoking a combustible contained within the chamber retention compartment, wherein the the smoke and vapor passes through the retention compartments as defined by the barrel, mouthpiece and chamber.

In one embodiment, the smoking pipe can be assembled and disassembled.

In one embodiment, the chamber contains a combustible and is heated by a heat source.

In one embodiment, smoke drawn through the smoking pipe filter is cleaned of particles and tar.

In one embodiment, the smoking pipe produces cleaned vapor.

In one embodiment, when using the smoking pipe the following steps occur: unpackaging the smoking pipe; rolling the filter into a cylinder; inserting the rolled filter into the mouthpiece; inserting the mouthpiece into the barrel; inserting the chamber into the barrel; loading the combustible into the chamber; holding the smoking pipe with index number one facing upward; heating first quadrant of the chamber while inhaling; rotating the smoking pipe with index number two facing upward; heating second quadrant of the chamber while inhaling; rotating the smoking pipe with index number three facing upward; heating third quadrant of the chamber while inhaling; rotating the smoking pipe with index number four facing upward; heating fourth quadrant of the chamber while inhaling; cooling off allowed as smoking session completed; disassembling and cleaning with cleaning tool; and reusing smoking pipe is now possible.

Additional aspects of the present invention will be apparent in view of the description which follows.

BRIEF DESCRIPTION OF THE FIGURES

The invention may be more completely understood in consideration of the following detailed description of various embodiments of the invention in connection with the accompanying drawings, in which.

Figure 1:
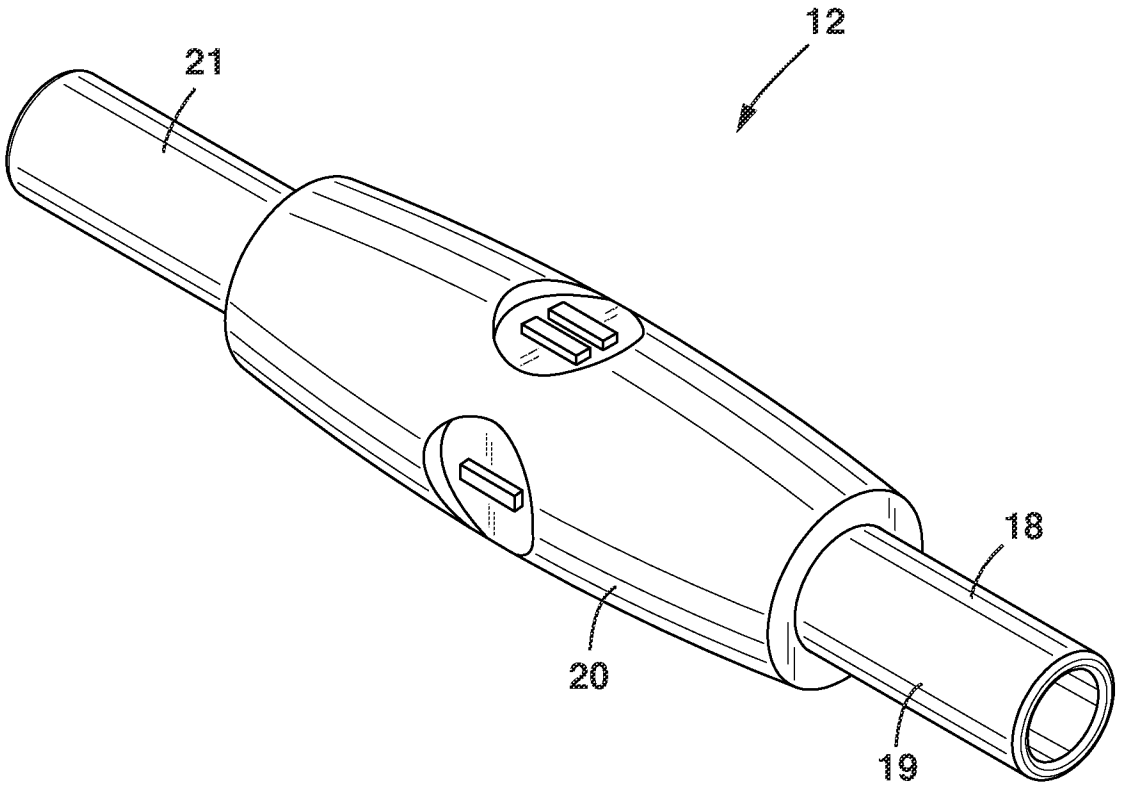
FIG. 1 is a perspective view of the front and left side of the smoking pipe.
Figure 2:
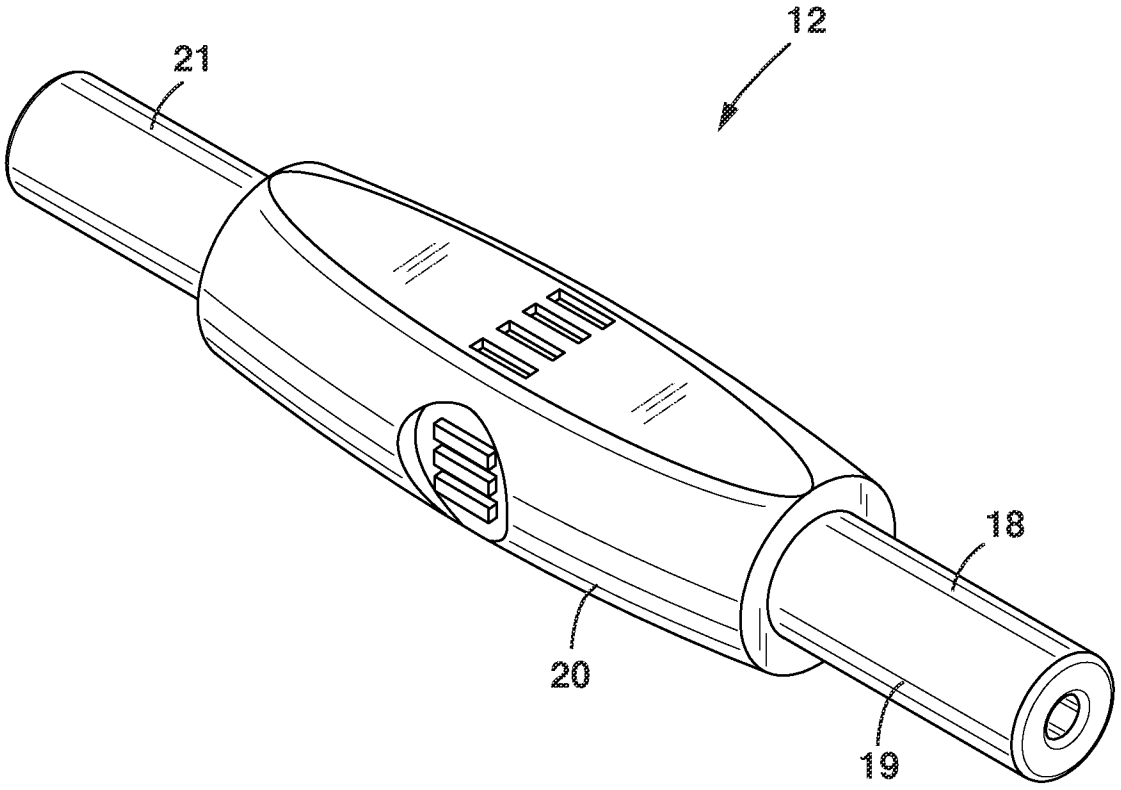
FIG. 2 is a perspective view of the bottom and right side of the smoking pipe.
Figure 4:
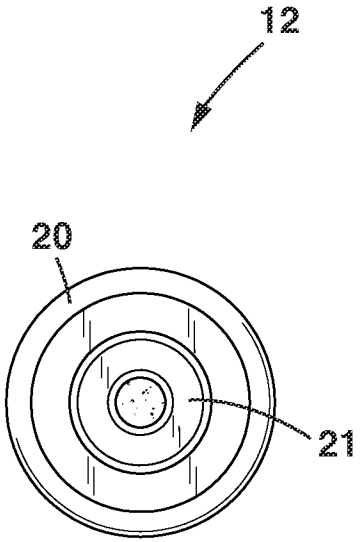
FIG. 4 is a rear elevation view thereof.
Figure 3:
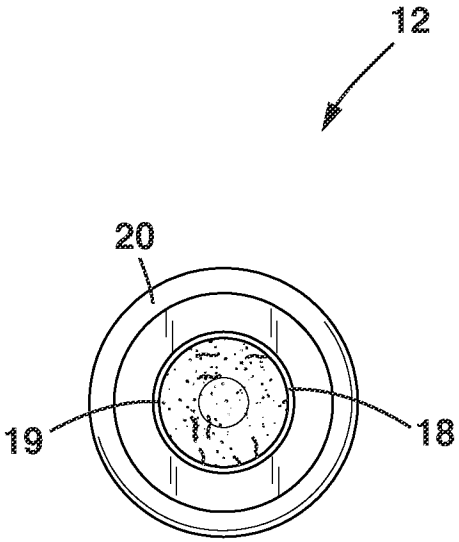
FIG. 3 is a front elevation view thereof.
Figure 5:
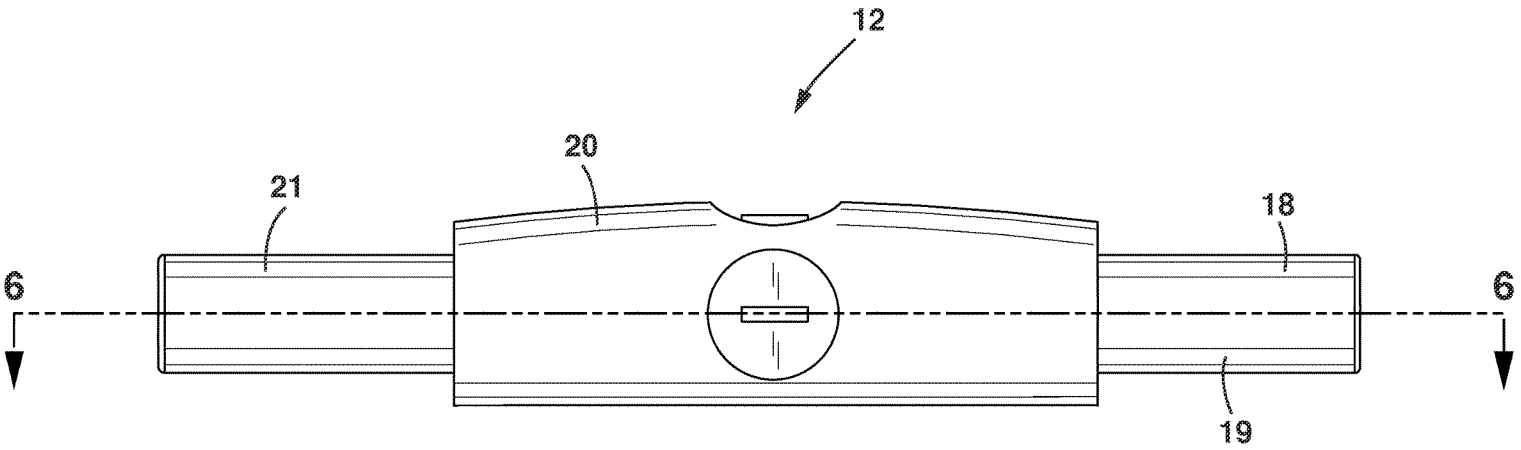
FIG. 5 is a left side elevation view thereof.

While the invention is amenable to various modifications and alternative forms, specifics thereof have been shown by way of example in the drawings and will be described in detail. However, it should be understood that the intention is not to limit the invention to the particular embodiments described but rather to include all modifications, equivalents, and alternatives.

DETAILED DESCRIPTION OF THE INVENTION

Referring to FIG. 1 through FIG. 7, a smoking pipe 12 embodiment is provided which, according to at least one, produces smoke 13 by using indirect heat from a heat source 14, such as a flame and/or achieves a healthier release of the desired chemical vapor 15 from the consumable 16 being smoked.

Generally, the smoking pipe 12 includes in a series a metal chamber 19, coupled to a barrel 20, which is further coupled to a mouthpiece 21. Each of these elements has a tubular construction that provides a continuous conduit for air to pass therethrough during inhalation by the user of pipe 12. Preferably, barrel 20 has a recess at each end to receive the mouthpiece 21 and the metal chamber 19 with a positive stop a desired distance into the barrel and so that these elements can extend outward from the barrel 20 sufficient distance to perform their respective function, as shown. Preferably, the metal chamber has an opening at the distal end that is larger than an opening at the proximal end. This allows the user to fill chamber 19 with a consumable 16 and for the consumable 16 to remain in situ during inhalation. Mouthpiece 21 has a similar set of openings, except that the larger opening is installed distally, to retain a filter 17 that remains in situ during inhalation.

The improvement beyond other devices comes in the use of heating with a flame and a preferably medical grade filter 17 sufficient to remove sub-micron sized particles and tar to provide a cleaner, healthier smoke. The filter 17 material should be changed when saturated. The metal chamber 19 may be a prefilled brass cartridge 18, which may be sized to contain the desired combustible smoking material. The brass will be sized to transfer sufficient heat to indirectly vaporize the consumable 16 or any portion thereof in no more than one second, using common lighting instruments, such as a lighter or match. The consumable 16 will preferably reach a temperature almost instantly, causing the desired volatile compounds therein to be released. Suction created by inhalation of the user will draw vapor 15 to the lungs of the user for the desired effect. Preferably, the smoking pipe 12 includes a filter 17, as discussed herein, in-line, which removes particulates so that the clean vapor 15 does not cause harsh irritation of the lungs along with the resultant coughing.

Preferably the smoking pipe 12 has a metal chamber 19 with a retention compartment to hold the consumable material. The metal chamber 19 may be a brass cartridge 18 not unlike one from any caliber ammunition. The cartridge 18 is preferably pressure fit into barrel 20 of the smoking pipe 12, as shown in the accompanying drawings, with the large opening outward and the smaller opening inward. Metal chamber 19 is heated by a flame for only 1 second or less on the side of chamber 19. The heat is conducted through the metal wall to the smoking material which easily reaches a temperature that releases the volatile compounds of the smoking material, without igniting the combustible material.

Figure 6:
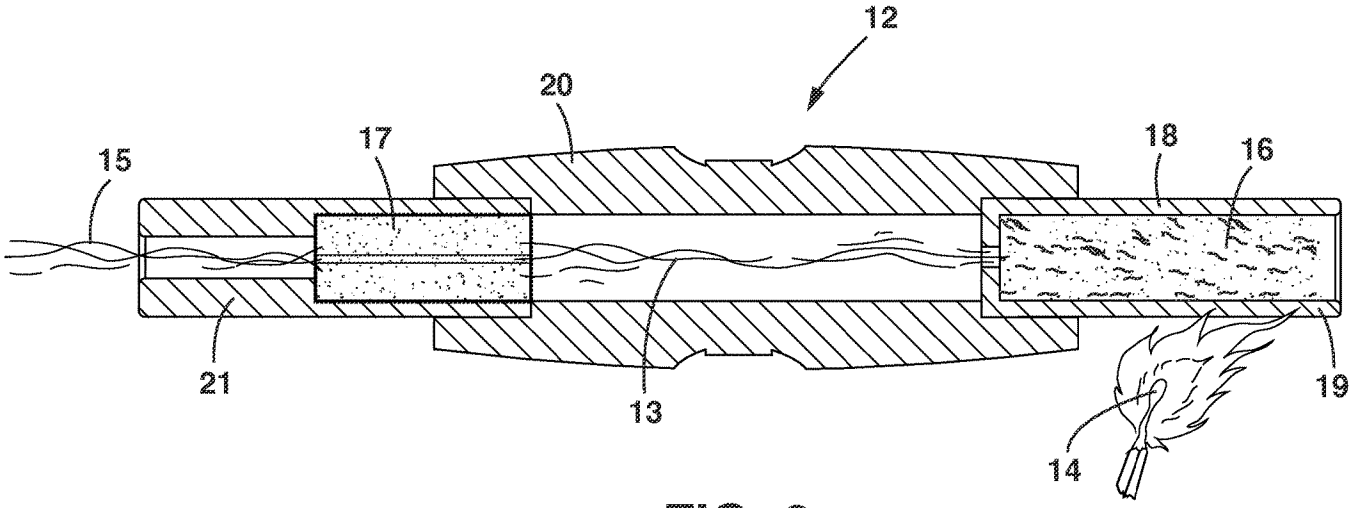
FIG. 6 is a center section view thereof.
Figure 7:
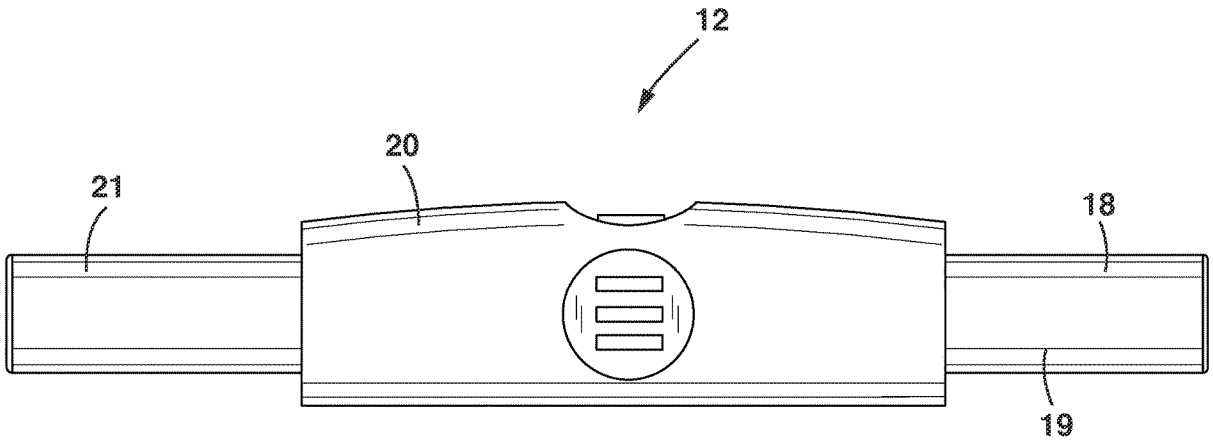
FIG. 7 is a right side elevation view thereof.
Figure 8:
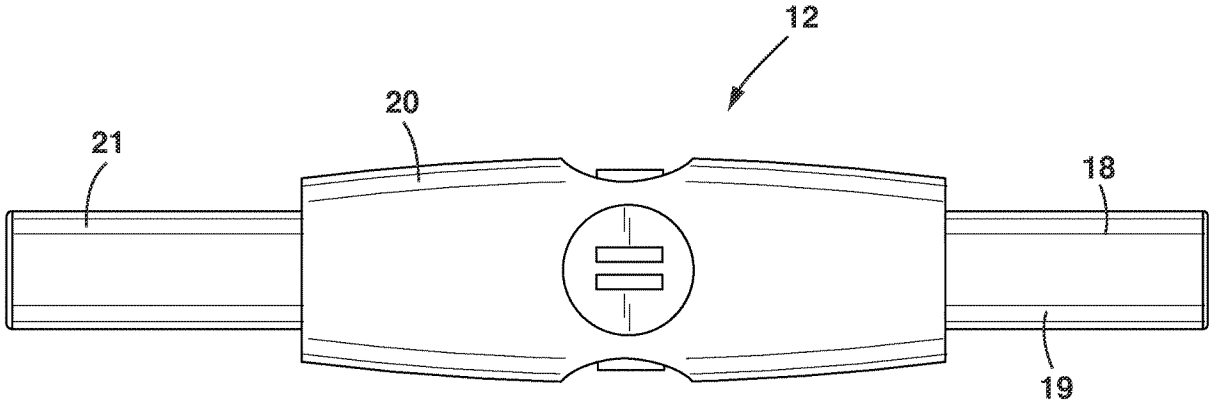
FIG. 8 is a top plan view thereof.
Figure 9:
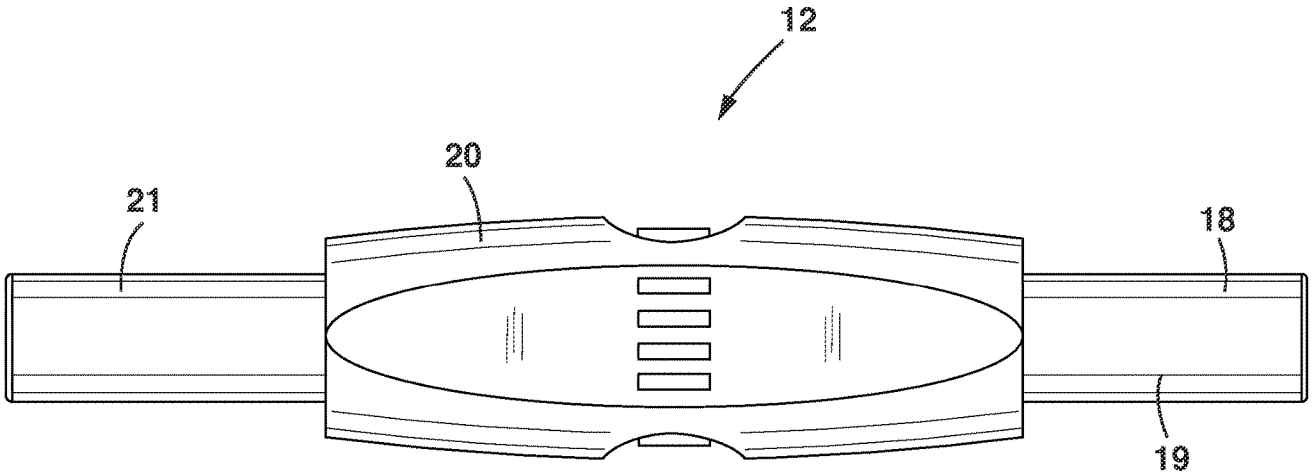
FIG. 9 is a bottom plan view thereof.
Figure 10:
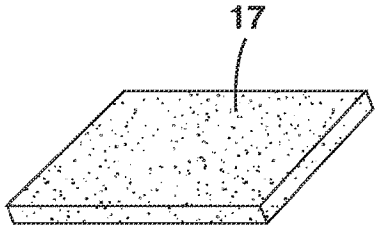
FIG. 10 is a perspective view of the filter.
Figure 11:
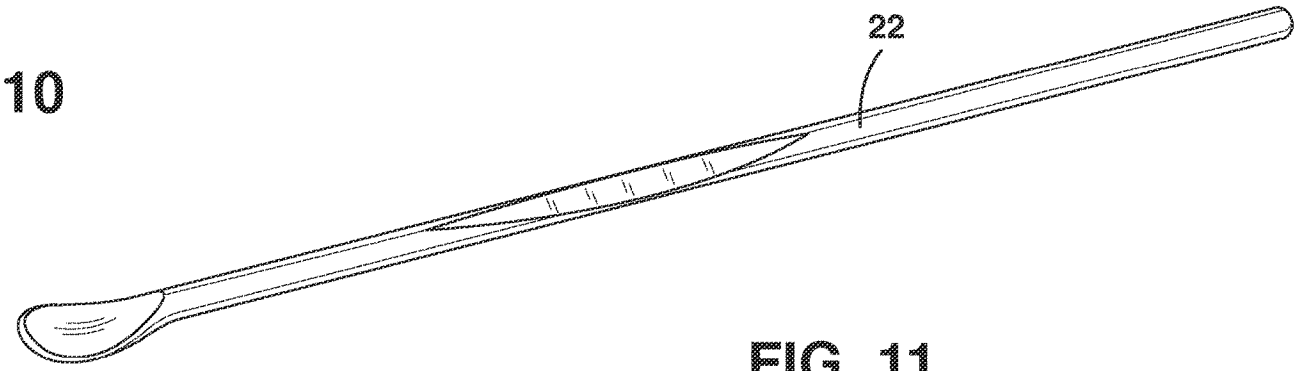
FIG. 11 is a perspective view of the cleaning device.

A heating/cooling chamber 19 is attached to a barrel 20, having a retention compartment, as shown in FIG. 6. The barrel 20 is preferably made from plastic. As vapor 15 travels through the barrel 20 to the mouthpiece 21 some tar or other impurities released by the heat may condense on the walls of the barrel 20 or will be collected in the filter for a cleaner vapor 15.

The mouthpiece 21, having a retention compartment, is removable from barrel 20 so as to provide safe sharing of the smoking pipe 12 with other users. The filter 17 material is replaced when saturated or becomes filled with particles and tar so as not to perform.

Mouthpiece 21 is preferably made from plastic and may be interference fit and is removable. The mouthpiece 21 holds a medical grade filter 17 material. The filter 17 material should be changed when saturated or when it creates a pressure drop such that it prevents smoke 13 from traveling through the smoking pipe 12. These particles and tar removed from the smoke 13 can severely irritate the lungs causing a significant amount of discomfort, coughing and possibly damage to the lung tissue.

The filter 17 material is cut, cold cut or heat cut to about 0.5 inches wide by 0.75 inches long by inches 0.0625 thick in size and tucked within the cavity of the mouthpiece 21. In one possible embodiment the filter 17 is cold cut from Technostat® 200 Plus filtration material made by Hollingsworth & Vose and converted by Superior, Felt & Filtration, LLC.

Tobacco and similar consumables ground to certain consistency may be the active ingredients commonly employed for smoking. The consumable 16 smoking material may be placed into cartridge 18. Heat generated by a flame applied to the cartridge 18 will volatilize the active ingredients in the consumables. The flame is preferably applied to one section/quadrant of the cartridge 18 for 1 second or less to produce smoke 13. Smoke 13 may then be drawn through the cartridge 18, the barrel 20, the mouthpiece 21 and filter 17 into the user's lungs. The barrel 20 may be indexed 1-4, as shown, so each quadrant can be heated individually and in succession to give off desired dosage of smoke 13 for medicinal purposes.

A smoking pipe 12 is reusable and can be disassembled for cleaning with a cleaning device 22 and reassembled for continued use.

Table A provides preferred dimensions for the smoking pipe 12.

TABLE A

| Element | Minor/Major Inside Diameter | length |
|---|---|---|
| Mouthpiece | 0.126-0.217 inches | 1.000 inches |
| Barrel | 0.270-0.378 inches | 2.313 inches |
| Chamber | 0.355 inches | 0.925 inches |
| Depth of recess in barrel to receive Mouthpiece | 0.370-0.378 inches | 0.125 inches |
| Depth of recess in Barrel to receive chamber | 0.370-0.378 inches | 0.125 inches |

In one embodiment, when using the smoking pipe 12 the following steps occur. (1.) Unpackaging the smoking pipe 12. (2.) Rolling the filter 17 into a cylinder. (3.) Inserting the rolled filter 17 into the mouthpiece 21. (4.) Inserting the mouthpiece 21 into the barrel 20. (5.) Inserting the chamber 19 into the barrel 20. (6.) Loading the consumable 16 into the chamber 19. (7.) Holding the smoking pipe 12 with index number one facing upward. (8.) Heating first quadrant of the chamber 19 while inhaling. (9.) Rotating the smoking pipe 12 with index number two facing upward. (10.) Heating second quadrant of the chamber 19 while inhaling. (11.) Rotating the smoking pipe 12 with index number three facing upward. (12.) Heating third quadrant of the chamber 19 while inhaling. (13.) Rotating the smoking pipe 12 with index number four facing upward. (14.) Heating fourth quadrant of the chamber 19 while inhaling. (15.) Cooling off allowed as smoking session completed. (16.) Disassembling and cleaning with cleaning device 22. (17.) And, reusing smoking pipe 12 is now possible.

While the foregoing invention has been described in some detail for purposes of clarity and understanding, it will be appreciated by one skilled in the art, from a reading of the disclosure, that various changes in form and detail can be made without departing from the true scope of the invention.

What is claimed is:

1. A smoking pipe comprising:

a barrel having an elongated tubular body having a first end and a second end opposite the first end, and at least one side extending between the first and second end;

a mouthpiece having an elongated tubular body having a first and a second end opposite the first end, and at least one side extending between the first and second end;

a metal chamber having an elongated body having a first and a second end opposite the first end, and at least one side extending between the first and second end;

wherein openings at each of the first and second ends of the barrel have recesses therein to receive the mouthpiece and the metal chamber;

wherein disparate sized openings at each of the first and second ends of the A mouthpiece for a space to insert a filter therein;

wherein openings at each of the first and second ends of the metal chamber for a space to insert a consumable therein, and wherein the barrel is index marked, which consists of a first index mark, a second index mark, a third index mark, and a fourth index mark, wherein each of the index marks is disposed circumferentially and equally spaced on the at least one side of the barrel such that each of the index marks represents a quadrant of the metal chamber, and wherein the barrel has a planar surface extending lengthwise between the first and second ends of the barrel with one of the index marks disposed on the planar surface;

wherein the metal chamber has a wall thickness that when heat from a lighter or match is applied from an outside surface of the metal chamber causes a release of volatile compounds from a combustible placed within the metal chamber in each of the quadrants in less than one second.

2. The smoking pipe of claim 1, wherein the barrel, the mouthpiece, and the metal chamber form a contiguously fixed assembly.

3. The smoking pipe of claim 1, wherein the mouthpiece and the metal chamber are removably attached to the barrel.

4. The smoking pipe of claim 2, wherein the mouthpiece and the metal chamber have an interference fit with the barrel.

5. The smoking pipe of claim 3, wherein the metal chamber is in the form of a prefilled cartridge.

6. The smoking pipe of claim 1, wherein the barrel has a flat surface on an outside thereof.

7. The smoking pipe of claim 1, comprising a cleaning device detached from the smoking pipe.

8. The smoking pipe of claim 1, further comprising set of instructions; and wherein the smoking pipe is arranged as a kit.

9. The smoking pipe of claim 1, wherein the metal chamber is made from brass and wherein the thickness of the brass is 0.005 inches to 0.20 inches.

10. The smoking pipe of claim 1, wherein the metal chamber is made from brass and wherein chamber extends outward from the barrel at least 0.50 inches.

11. The smoking pipe of claim 1, wherein the mouthpiece has an inside diameter of 0.126 inches to 0.217 inches.

12. The smoking pipe of claim 1, wherein the barrel has an inside diameter of 0.270 inches to 0.378 inches.

13. The smoking pipe of claim 1, wherein the metal chamber has an inside diameter of 0.355 inches.

14. The smoking pipe of claim 1, wherein a depth of a recess in the barrel to receive a mouthpiece is 0.370 inches to 0.378 inches.

15. The smoking pipe of claim 1, wherein a depth of a recess in the barrel to receive the metal chamber is 0.370 inches to 0.378 inches.

16. The smoking pipe of claim 1, wherein a size of the filter disposed within the mouthpiece is 0.5 inches wide by 0.75 inches long by 0.0625 inches thick.

17. A method for using a smoking pipe according to claim 1, the method comprising the steps:

(a) Unpackaging the smoking pipe;

(b) Rolling a filter into a cylinder;

(c) Inserting the rolled filter into the mouthpiece;

(d) Inserting the mouthpiece into the barrel;

(e) Inserting the metal chamber into the barrel;

(f) Loading a consumable into the metal chamber;

(g) Holding the smoking pipe with the first index mark facing upward;

(h) Heating a first quadrant of the metal chamber associated with the first index mark while inhaling;

(i) Rotating the smoking pipe with the second index mark facing upward;

(j) Heating a second quadrant of the metal chamber associated with the second index mark while inhaling;

(k) Rotating the smoking pipe with the third index mark facing upward;

(l) Heating a third quadrant of the metal chamber associated with the third index mark while inhaling;

(m) Rotating the smoking pipe with the fourth index mark facing upward; and (n) Heating a fourth quadrant of the metal chamber associated with the fourth index mark while inhaling.

* * * * *